US005738593A

United States Patent [19]

Coury et al.

[11] Patent Number: 5,738,593

[45] Date of Patent: Apr. 14, 1998

[54] APPARATUS AND METHOD FOR INTRODUCING GOLF BALLS TO AN AIR DRIVEN TRANSPORTATION SYSTEM

[75] Inventors: Michael P. Coury, Gig Harbor; Philip S. Coury, Tacoma, both of Wash.

[73] Assignee: Airball Enterprises L.L.C., Gig Harbor, Wash.

[21] Appl. No.: 785,879

[22] Filed: Jan. 21, 1997

[51] Int. Cl.[6] ..... A63B 69/36

[52] U.S. Cl. ..... 473/135; 473/166

[58] Field of Search ..... 473/132, 135, 473/136, 166, 163, 182, 183, 184, 191, 194; 124/56, 58, 60, 70, 71, 73, 77

[56] References Cited

U.S. PATENT DOCUMENTS

| | | | |
|---|---|---|---|
| 3,260,527 | 7/1966 | Younce | 473/166 |
| 3,567,223 | 3/1971 | Gentiluomo | 473/166 |
| 4,272,078 | 6/1981 | Vinette | 473/166 |
| 5,228,168 | 7/1993 | Hollrock et al. . | |
| 5,507,271 | 4/1996 | Actor | 124/71 |

OTHER PUBLICATIONS

"Automatic Range Ball Delivery Systems," Hollrock Engineering, Inc. Brochure, date unknown.

"Ball Processing," Range Land Brochure, Jan. 21, 1997.

*Primary Examiner*—Steven B. Wong

*Attorney, Agent, or Firm*—Christensen O'Connor Johnson & Kindness PLLC

[57] ABSTRACT

Air flowing in a transportation conduit delivers golf balls from a central repository to dispensers located throughout a driving range. An apparatus for introducing the golf balls into this flowing stream of air includes a valving system capable of introducing batches of balls in an air stream flowing in a substantially horizontal direction. The valving system is controlled by a compressor and timer. An optional vacuum system is provided to deliver the golf balls to the apparatus for introducing the golf balls into the air stream in those situations where gravity cannot be relied upon to deliver the golf balls to the entrance of the apparatus.

16 Claims, 1 Drawing Sheet

APPARATUS AND METHOD FOR INTRODUCING GOLF BALLS TO AN AIR DRIVEN TRANSPORTATION SYSTEM

FIELD OF THE INVENTION

The present invention generally relates to an apparatus and a method for efficiently and safely transporting balls, especially golf balls, from one location to another location.

BACKGROUND OF THE INVENTION

With the popularity of golf, and the limited number of courses available for play, avid golfers typically hone their skills by visiting driving ranges on a periodic basis. These driving ranges provide the golfers with containers of balls for practice. Typically, these balls are dispensed from a mechanical dispenser. In larger ranges, these mechanical dispensers are distributed throughout the facility. After the balls are driven into the range, they are retrieved to a central location where they are collected for delivery back to the dispensing units or washed and then delivered to the dispensing units.

Presently, manual labor is used to deliver these balls back to the dispensers. Typically this involves filling large containers, such as garbage cans full of balls, and then transporting the ball-filled garbage cans on a cart or trailer to the various dispensers. Because most dispensers are top loading units, laborers are required to lift these heavy containers over their heads in order to dump the balls into the dispenser. This task is cumbersome at best and also is very physically demanding. Because of the weight of the balls and the difficulty in handling large containers, the potential for injuries to the laborers' back or legs exists. Furthermore, the cost of this manual labor is significant.

As an improvement to the manual distribution of golf balls to dispensers, U.S. Pat. No. 5,228,168 to Hollrock et at. describes a ball delivery system that relies upon moving air in a substantially vertical conduit to deliver the balls from a central location to an inclined conduit where the balls roll by gravity to a remote dispenser. These types of delivery systems while meritorious in design have suffered from a lack of commercial acceptance, partially due to their inability to deliver balls over extended distances.

Another reason that these systems have met with minimal commercial acceptance is their inability to effectively and quickly introduce batches of balls into a horizontally flowing air stream. The Hollrock patent describes a system for introducing one ball at a time into a vertically rising air stream. Hollrock uses a vertically rising air stream because Hollrock elevates the balls to a point where they can be gravity fed into a dispenser. Based on the illustration in the Hollrock patent, gravity is the primary force serving to transport the balls once they are elevated by the air stream.

In order to deliver the balls the large distances, e.g., 100–500+ feet, that are required at larger ranges, it is necessary to introduce batches of balls into a horizontally moving air stream that is flowing at a velocity necessary to transport the balls these distances. Because of the availability of manual labor to distribute the balls, such a system must be capable of reliably operating in a cost effective manner over extended periods of time.

SUMMARY OF THE INVENTION

The present invention relates to an apparatus for delivering golf balls to a transportation conduit through which a stream of air flows and serves to transport the balls from one location to another. Preferably, the golf balls are introduced in batches of two or more as opposed to singly. The apparatus relies upon gravity to provide the driving force for introducing the balls into the stream of air. In a preferred embodiment, the stream of air is traveling in a substantially horizontal direction.

An apparatus formed in accordance with the present invention includes a delivery conduit for receiving balls and delivering the balls to a transportation conduit (connected to the delivery conduit) via a stream of air flowing in the delivery conduit. Connected to the delivery conduit is a feed conduit having an entrance end and an exit end opposite the entrance end. The feed conduit intermediate the entrance end and the exit end includes a first valve and a second valve spaced from the first valve. A staging section is defined between these valves. When the first valve is open, balls may pass from the entrance end of the feed conduit into the staging section. When the second valve is open, balls may pass from the staging section to the exit end of the feed conduit and into the delivery conduit. The first valve, when closed, separates the entrance end from the staging section such that balls cannot pass into the staging section from the entrance end. Likewise, the second valve, when closed, separates the staging section from the exit end such that balls cannot pass from the staging section to the exit end.

In another aspect, the present invention relates to a method for introducing golf balls into a transportation conduit at a first location, wherein the transportation conduit transports the balls from the first location to a second location remote from the first location using a stream of air flowing through the transportation conduit. A method carried out in accordance with this aspect of the present invention includes the steps of providing a delivery conduit connected to the transportation conduit and providing a feed conduit connected to the delivery conduit, wherein the feed conduit has an entrance end and an exit end opposite the entrance end. The feed conduit intermediate the entrance end and the exit end includes a first valve and a second valve spaced from the first valve. A staging section is defined between these valves. When the first valve is open, balls may pass into the staging section from the entrance end of the feed conduit. When the second valve is open, balls may pass from the staging section to the exit end. The first valve, when closed, separates the staging section from the entrance end such that balls cannot pass into the staging section from the entrance end. The second valve, when closed, separates the staging section from the exit end such that balls cannot pass from the staging section to the exit end. One cycle of the method starts with the second valve being closed and the first valve being open. This permits a plurality of balls to pass from the entrance end of the feed conduit into the staging section. The first valve is then closed followed by opening of the second valve that permits the plurality of balls to leave the staging section and exit the feed conduit as they are introduced into the delivery conduit where the balls are then delivered to the transportation conduit. The second valve is then closed and the first valve opened to restart the cycle.

The apparatus and method of the present invention allow for the effective and efficient introduction of golf balls into a flowing air stream. The apparatus and method use commercially available components that provide reliable and cost effective performance. The practice of the present invention permits range owners to deliver golf balls to dispensers that are extended distances (e.g., 500+feet) from a central location where the balls are introduced into the stream of air flowing in a transportation conduit. The apparatus has a minimum number of mechanical parts, can be constructed economically and has proven to operate reliably with low maintenance requirements. The apparatus and method will allow range operators to quickly recoup their initial investment in such a system by avoiding the cost associated with the manual labor needed to deliver the balls to the dispensers.

BRIEF DESCRIPTION OF THE DRAWINGS

The foregoing aspects and many of the attendant advantages of this invention will become more readily appreciated as the same becomes better understood by reference to the following detailed description, when considered in conjunction with the accompanying drawings, wherein.

DETAILED DESCRIPTION OF THE PREFERRED EMBODIMENT

Figure 1:
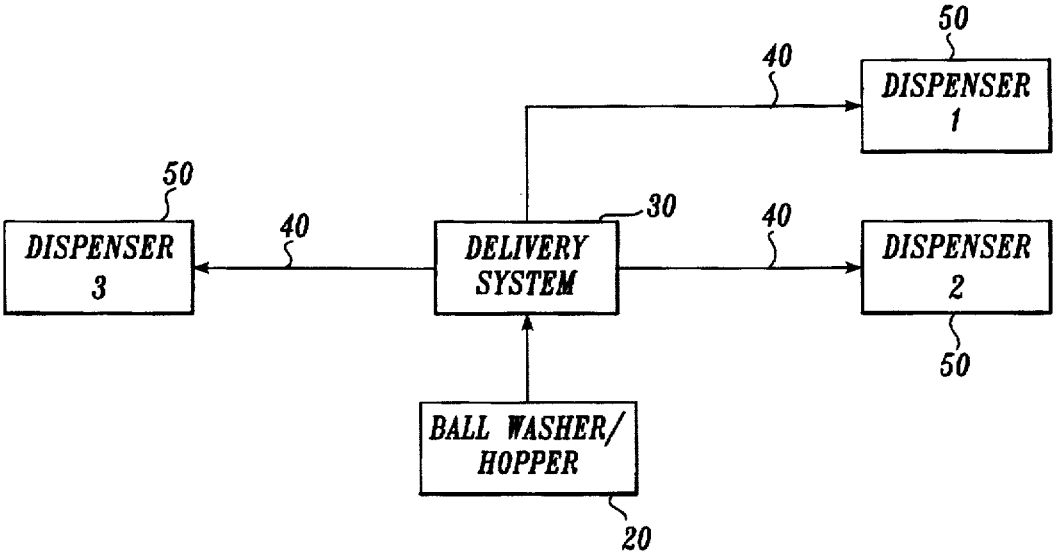
FIG. 1 is a schematic illustration of a ball delivery system.

Referring to FIG. 1, a typical driving range includes an arrangement of a ball washer/hopper 20 that delivers golf balls to a delivery system 30 in which the apparatus and method for introducing balls into a flowing air stream is implemented. The air stream receives the balls and delivers them through lines 40 to dispensers 50 located at various locations around the driving range.

Lines 40 are typically round tubing, preferably having an inner diameter of approximately two inches. It should be understood that the inner diameter of air lines 40 may vary depending upon the size of the golf balls, the length of the run, and the pressure needed within the air lines. Lines 40 can be made from any material, such as flexible plastic, suitable for burying underground and for running through structural elements of a building. As described below in more detail, one end of an air line is in fluid communication with a ball delivery system formed in accordance with the present invention. The opposite end of the air line feeds into a dispenser 50. Depending upon the number of dispensers, a single air line is attached to the ball delivery system 30 and then a downstream Y or other structure can be provided to direct the balls to additional air lines connected to different dispensers.

Figure 2:
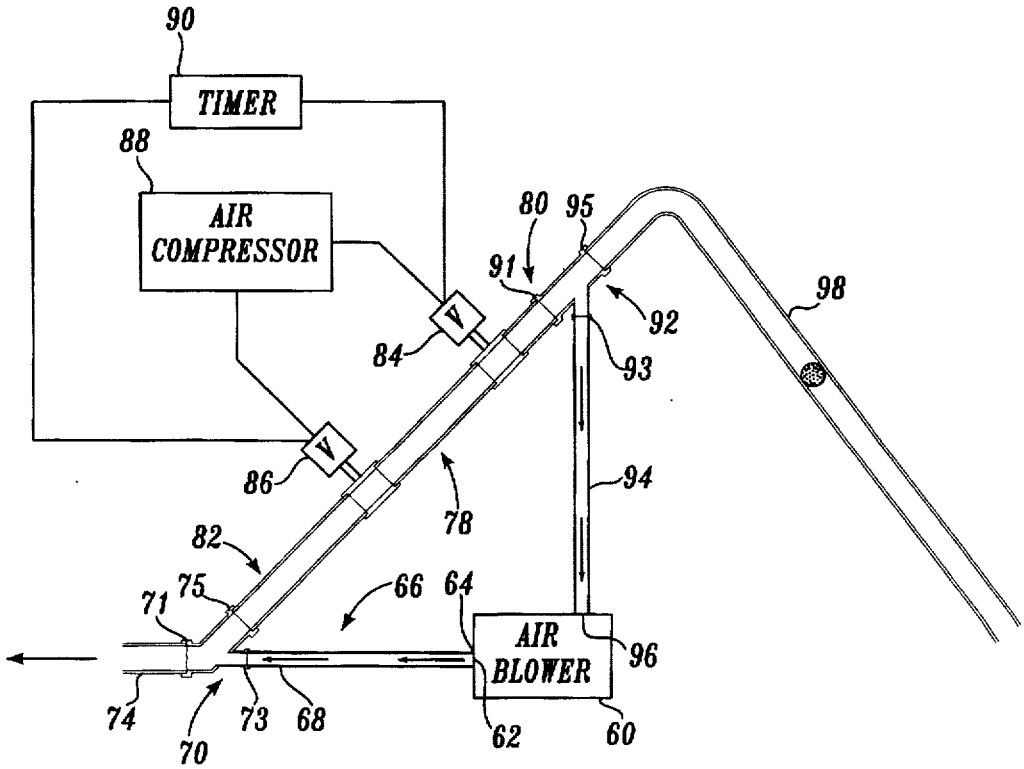
FIG. 2 is a schematic illustration of a system for introducing golf balls into a transportation conduit carrying a stream of air formed in accordance with the present invention.

In the following description, transportation conduit 74 in FIG. 2 is identical to air lines 40 in FIG. 1. Referring to FIG. 2, an embodiment of an apparatus for delivering golf balls to a transportation conduit includes an air blower 60 having an exhaust port 62 that is connected to the entrance end 64 of an air supply line 66. The opposite end 68 of air supply line 66 is connected to a Y-shaped coupling 70. Y-shaped coupling 70 includes an exit 71, a primary entrance 73 and a secondary entrance 75. The primary entrance and secondary entrance are defined by the arms of the Y and the exit is defined by the base of the Y-shaped coupling. A straight path for air to flow is defined between exit 71 and primary entrance 73, with secondary entrance 75 forming an acute angle with this straight path. Exit 71 of coupling 70 is connected to the inlet of transportation conduit 74. Air blower 60 provides a flow of air through air supply line 66 and coupling 70, and when transportation conduit 74 is coupled to coupling 70, into the transportation conduit.

The air supply line 66 and coupling 70 cooperate to provide a delivery conduit into which balls are introduced in accordance with the present invention and ultimately delivered to transportation conduit 74. In the above description, air supply line 66 and coupling 70 are treated as elements separate from transportation conduit 74. It should be understood that air supply line 66 and coupling 70, and the delivery conduit they define could also be considered to be part of transportation conduit 74, or vice versa, a part of the transportation conduit could perform the function of air supply line 66 and coupling 70.

Air supply line 66 can be made from any airtight material suitable for transporting a flow of air. In a preferred embodiment, air supply line 66 is a plastic tube having an inner diameter of about one and one-half inches. Coupling 70, like air supply line 64, is also made from an airtight material, preferably, plastic such as the type used in the plumbing industry. In a preferred embodiment, coupling 70 has an inner diameter of about two inches. In order to fit snugly with the smaller air supply conduit, coupling 70 at secondary entrance 75 is sized to accommodate the smaller diameter of the air supply line compared to the larger diameter of the transportation conduit 74.

Secondary entrance 75 is provided between primary entrance 73 and exit 71 of coupling 70 and in the illustrated embodiment forms an approximate 45 degree angle with the path defined between exit 71 and primary entrance 73 as described above. While in the illustrated embodiment, the angle is approximately 45 degrees, it should be understood that larger or smaller angles are also considered to be within the scope of the present invention. Larger angles, e.g., 45°–90°, are preferred when it is desirable to provide more acceleration to the balls as they enter the flowing air stream. When the angle is smaller, less acceleration is provided to the balls. Secondary entrance 75 is coupled to the exit end 82 of feed pipe 78 as described below in more detail.

Feed pipe 78 is an elongate, preferably plastic, tube having an inner diameter of about two inches. Feed pipe 78 includes an exit end coupled to entrance port 75 of coupling 70 as explained above. Feed pipe 78 slopes downward at an angle equivalent to the angle formed by the secondary entrance 75 of coupling 70. The end of feed pipe 78 opposite exit end 82 defines an entrance end 80 into which golf balls are introduced as described below in more detail.

Intermediate exit end 82 and entrance end 80 are entrance valve 84 and exit valve 86. Entrance valve 84 is closer to entrance end 80 and exit valve 86 is closer to exit end 82. Entrance valve 84 and exit valve 86 are spaced apart and define a staging section therebetween. The spacing between entrance valve 84 and exit valve 86 can vary depending upon the number of balls that one desires to place in the staging section. Applicants have found that a staging section approximately 18 inches long is suitable when one desires to introduce batches comprising two or more balls at a time, preferably 10–15 balls can be introduced as a batch. When either entrance valve 84 or exit valve 86 is closed, golf balls and air cannot flow through feed pipe 78. In a preferred embodiment, both valves 84 and 86 are pneumatic valves, and more preferably pneumatic ball valves, such as those available as Model 220-THR-FP-316 from Familian Northwest. Pneumatic valves are preferred because of their ability to reset themselves when the closing of the valve is blocked, for example, by a golf ball. In contrast, electronic valves are more likely to burn themselves out as they repeatedly try to close when they are blocked by a golf ball. Ball valves in contrast to other types of valves are preferred because the ball valves when open provide an unrestricted path through the valve. When pneumatic in nature, air pressure is provided to these valves by compressor 88, such as a Speedaire Model No. 4B214. Operation of the valve is controlled as described below in more detail by conventional delay-relay timer 90, such as a Model No. 1A367 available from W. W. Grainger.

In the illustrated embodiment, the apparatus for delivering golf balls is provided with an optional vacuum feature to enable the user to "suck" golf balls into entrance end 80 of feed pipe 78. It should be understood that the present invention is not limited to this suction feature and that golf balls may be delivered directly to entrance end 80 by gravity, such as from a ball washer or hopper capable of delivering balls to entrance end 80 from an elevation above entrance end 80.

In accordance with this aspect of the present invention, entrance end 80 of feed pipe 78 is connected to a primary exit 91 of another Y-shaped coupling 92. Y-shaped coupling 92 includes a primary exit 91 and a secondary exit 93 that are defined by the arms of the Y-shaped coupling. The leg of the Y-shaped coupling defines an entrance 95. The primary path through Y-shaped coupling 92 is defined between primary exit 91 and entrance 95. Secondary exit 93 extends from Y-shaped coupling at a location intermediate primary exit 91 and entrance 95 and forms an acute angle therewith. The secondary exit 93 is connected to one end of a conduit 94 that has its opposite end connected to the intake 96 of air blower 60. Entrance 95 is coupled to one end of a suction pipe 98. The opposite end of suction pipe 98 is open and provides an entrance through which golf balls may be sucked and delivered to entrance end 80 of feed conduit 78. In order to prevent golf balls that have been sucked into coupling 92 from blocking secondary exit 93, the inner diameter of secondary outlet 93 is smaller than the outer diameter of the golf balls, e.g., about one and one-half inches or less. This allows the secondary outlet 93 to reject and prevent the golf balls from becoming lodged in this portion of the Y and thus preventing the vacuum provided by the air blower from extending into the suction pipe. Suction pipe 98, like feed pipe 78 and transportation conduit 74, is preferably a plastic tube having an inner diameter of about two inches. Coupling 92 is also preferably a plastic coupling similar to those used in the plumbing industry and has an inner diameter of approximately two inches between the primary exit 91 and entrance 95 and an inner diameter of approximately one and one-half inches in the secondary exit 93.

It should be understood that the exemplary materials and dimensions of the respective elements of an apparatus formed in accordance with the present invention have been described above. The use of pipes, couplings and valves having different configurations or being made from different materials are considered to be within the scope of the present invention.

The following describes the operation of the apparatus for delivering golf balls to a transportation conduit described above without the optional suction feature. Initially, air blower 60 is activated and provides air flow through air supply line 66 and coupling 70 into transportation conduit 74. Applicants have found that a one horsepower electric Fiji vortex blower, such as a Model 42751 provides suitable flow of air through these respective conduits. It should be understood that the present invention is not limited to such size of blower and that larger or smaller blowers may be utilized depending upon the particular requirements of a particular driving range. The one horsepower vortex blower was found suitable for delivering golf balls over lengths of at least 300 feet, when two-inch plastic tubing was used for transportation conduit 74. If golf balls are to be delivered over shorter distances, blowers having less horsepower may be suitable; on the other hand, if balls are to be delivered over larger distances, it may be necessary to use a blower having greater horsepower.

The transportation conduits 74 are preferably relatively air tight. When run underground, it is preferred that the conduits be accessible at spaced intervals in order to clear the conduits of blockages. In order to adjust the pressure in the conduits, one can provide exhaust ports at periodic locations. In order to eliminate noise and wear, any change in directions in the conduits is preferably provided by smooth transitional curves provided by flexible tubing as opposed to sharp elbows.

Golf balls from a washer or hopper are available for delivery by gravity into entrance end 80 of feed pipe 78. Initially, timer 90 controls valves 84 and 86 so that valve 84 is open, while valve 86 is closed. Gravity causes golf balls introduced into entrance end 80 of feed pipe 78 to roll down against closed valve 86. Because valve 86 is closed, air flowing through coupling 70 is unable to blow back up through feed pipe 78 past valve 86. After a predetermined period of time generally selected to ensure a large enough number of golf balls fills the staging section, timer 90 causes valve 84 to close, thus preventing any additional golf balls from passing into the staging section. The number of golf balls in the staging section to be delivered to the flowing stream of air is preferably at least two, and more preferably 10–15. By ensuring that more than one golf ball is delivered at a time, the system does not have to cycle as quickly, thus reducing the wear and tear and maintenance required for the valving system. After entrance valve 84 is closed, timer 90 opens valve 86, thus allowing the golf balls in the staging section to roll into coupling 70 and into the stream of air supplied by air supply line 66. Any possible flow of air through feed pipe 78 and out entrance 80 is blocked by closed valve 84. Thus, there is no "rush" of air through feed pipe in a direction opposite to that which the balls need to roll in order to leave the staging section. In fact, because of a venturi effect created by the flow of air past the location where secondary entrance 75 introduces the balls into the flowing air stream, the batch of balls tends to be sucked out of the staging section and into the flowing air. After a predetermined period of time sufficient to allow the golf balls to pass by valve 86, timer 90 closes valve 86 and opens valve 84, thus permitting the loading cycle to repeat itself.

When the optional suction delivery system is employed, the connection to the air intake of air blower 60 provides the needed suction to pick up golf balls through line 94, coupling 92, and suction pipe 98. In this manner, balls at a location which do not allow them to be delivered by gravity into entrance 80 of feed pipe 78 can be sucked up to a point where they can be delivered by gravity into entrance 80. This feature of the present invention makes the present invention more readily adaptable to preexisting operations that do not provide a ball washer or hopper having the necessary elevation to deliver the golf balls via gravity to the feed pipe.

The present invention provides a reliable and effective means of delivering golf balls into a flowing stream of air for delivery to remote locations. It should be understood that the present invention has been described in the context of a preferred embodiment and that other configurations relying upon the unique valving system and suction feature described above are within the scope of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for delivering golf balls to a transportation conduit at a first location, the transportation conduit transporting the balls from the first location to a second location remote from the first location using a stream of air flowing through the transportation conduit, the apparatus comprising:

a delivery conduit for receiving balls and delivering the balls to the transportation conduit via a stream of air flowing in the delivery conduit;

a feed conduit having an entrance end an exit end, the feed conduit intermediate the entrance end and the exit end including a first valve and a second valve spaced from the first valve, a staging section defined between the first valve and the second valve, the staging section being open to the to the entrance end when the first valve is open such that balls may pass through from the entrance end into the staging section, the staging section being open to the exit end when the second valve is open such that balls may pass from the staging section through the exit end, the first valve when closed separating the entrance end from the staging section such that balls cannot pass through the entrance end into the staging section, the second valve when closed separating the staging section from the exit end such that balls cannot pass from the staging section through the exit end, the exit end of the feed conduit connected to the delivery conduit; and a valve control system for maintaining the first valve open a period of time sufficient to permit more than one ball to collect in the staging section while the second valve is closed.

2. The apparatus of claim 1, further comprising a blower connected to the delivery conduit.

3. The apparatus of claim 2, further comprising a suction conduit having one end connected to the entrance end of the feed conduit for delivering balls to the entrance end via suction.

4. The apparatus of claim 3, wherein the blower includes an intake port in fluid communication with the suction conduit.

5. The apparatus of claim 1, wherein the feed conduit and the delivery conduit intersect at an angle ranging from about 45° to about 90°.

6. The apparatus of claim 1, wherein the first and second valves are pneumatic valves.

7. The apparatus of claim 6, wherein the pneumatic valves are ball valves.

8. The apparatus of claim 1, wherein the first valve when closed prevents flow of air between the staging section and the entrance end.

9. The apparatus of claim 1, wherein the second valve when closed prevents the flow of air between the exit end and the staging section.

10. A method for introducing golf balls into a transportation conduit at a first location, wherein the transportation conduit transports the balls from the first location to a second location remote from the first location using a stream of air flowing through the transportation conduit, the method comprising the steps:

providing a delivery conduit connected to the transportation conduit;

providing a feed conduit connected to the delivery conduit, the feed conduit having an entrance end and an exit end opposite the entrance end, the feed conduit intermediate the entrance end and the exit end including a first valve and a second valve spaced from the first valve, a staging section defined between the first valve and the second valve, the staging section being open to the entrance end when the first valve is open such that balls may pass through the entrance end into the staging section, the staging section being open to the exit end when the second valve is open such that balls may pass from the staging section through the exit end, the first valve when closed separating the staging section from the entrance end such that balls cannot pass through the entrance end into the staging section, the second valve when closed separating the staging section from the exit end such that balls cannot pass from the staging section through the exit end;

closing the second valve;

opening the first valve;

introducing a plurality of balls through the entrance end into the staging section;

closing the first valve;

opening the second valve to permit the plurality of balls to leave the staging section and be introduced into the delivery conduit.

11. The method of claim 10, further comprising the step of introducing the balls into the entrance end by gravity.

12. The method of claim 1, wherein the step of closing the second valve prevents airflow between the exit end and the staging section.

13. The method of claim 1, wherein the step of closing the first valve prevents airflow between the staging section and the entrance end.

14. An apparatus for delivering golf balls to a transportation conduit at a first location, the transportation conduit transporting the balls from the first location to a second location remote from the first location using a stream of air flowing through the transportation conduit. The apparatus comprising:

a delivery conduit for receiving balls and delivering the balls to the transportation conduit via a stream of air flowing in the delivery conduit;

a blower connected to the delivery conduit;

a feed conduit having an entrance and an exit end, the feed conduit intermediate the entrance end and the exit end including a first valve and a second valve spaced from the first valve, a staging section defined between the first valve and the second valve, the staging section being open to the entrance end when the first valve is open such that balls may pass through from the entrance end into the staging section, the staging section being open to the exit end when the second valve is open such that balls may pass from the staging section through the exit end, the first valve when closed separating the entrance end from the staging section such that balls cannot pass through the entrance end into the staging section, the second valve when closed separating the staging section from the exit end such that balls cannot pass from the staging section through the exit end, the exit end of the feed conduit connected to the delivery conduit; and a suction conduit having one end connected to the entrance end of the feed conduit for delivering balls to the entrance end via suction.

15. The apparatus of claim 14, wherein the blower includes an intake port in fluid communication with the suction conduit.

16. A method for introducing golf balls into a transportation conduit at a first location, wherein the transportation conduit transports the balls from the first location to a second location remote from the first location using a stream of air flowing through the transportation conduit, the method comprising the steps:

providing a delivery conduit connected to the transportation conduit;

providing a feed conduit connected to the delivery conduit, the feed conduit having an entrance end and an exit end opposite the entrance end, the feed conduit intermediate the entrance end and the exit end including a first valve and a second valve spaced from the first valve, a staging section defined between the first valve and the second valve, the staging section being open to the entrance end when the first valve is open such that balls may pass through the entrance end into the staging section, the staging section being open to the exit and when the second valve is open such that balls may pass from the staging section through the exit end, the first valve when closed separating the staging section from the entrance end such that balls cannot pass through the entrance end into the staging section, the second valve when closed separating the staging section from the exit end such that balls cannot pass from the staging section through the exit end;

closing the second valve;

opening the first valve;

introducing a plurality of balls through the entrance end into the staging section using a suction conduit;

closing the first valve; and opening the second valve to permit the plurality of balls to leave the staging section and be introduced into the delivery conduit.

* * * * *

UNITED STATES PATENT AND TRADEMARK OFFICE

CERTIFICATE OF CORRECTION

PATENT NO. : 5,738,593
DATED : April 14, 1998
INVENTOR(S) : M.P. Coury et al.

It is certified that error appears in the above-identified patent and that said Letters Patent is hereby corrected as shown below:

| COLUMN | LINE | |
|---|---|---|
| 8 (Claim 12, | 28 line 1) | "of claim 1," should read --of claim 10,-- |
| 8 (Claim 13, | 31 line 1) | "of claim 1," should read --of claim 10,-- |
| 9 (Claim 16, | 18 line 18) | "exit and" should read --exit end-- |

Signed and Sealed this

Twentieth Day of October, 1998

*Attest:*

*Attesting Officer*

BRUCE LEHMAN

*Commissioner of Patents and Trademarks*